US006564736B2

(12) United States Patent
Courtay

(10) Patent No.: US 6,564,736 B2
(45) Date of Patent: May 20, 2003

(54) DEVICE FOR INSTALLING AND/OR REMOVING A STEERABLE PROPULSION POD FOR A SHIP

(75) Inventor: Roger Courtay, Herbignac (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/125,431

(22) Filed: Apr. 19, 2002

(65) Prior Publication Data

US 2003/0003820 A1 Jan. 2, 2003

(30) Foreign Application Priority Data

Jun. 20, 2001 (FR) ..... 01 08494

(51) Int. Cl.[7] ..... B63H 1/14
(52) U.S. Cl. ..... 114/65 R; 440/53; 440/113
(58) Field of Search ..... 114/65 R; 440/49, 440/53, 113

(56) References Cited

U.S. PATENT DOCUMENTS 3,586,190 A * 6/1971 Lafferty ..... 414/607
3,741,143 A 6/1973 McKinley
4,048,936 A * 9/1977 Uchizono et al. ..... 114/65 R
4,400,133 A * 8/1983 Booker ..... 414/589
4,586,907 A * 5/1986 Florander ..... 440/49
4,634,389 A * 1/1987 Eptaminitakis ..... 440/53
4,654,012 A 3/1987 Bliss
4,692,087 A * 9/1987 Olsen ..... 414/680
4,696,650 A * 9/1987 Haglund ..... 440/49
5,823,708 A * 10/1998 Dwight et al. ..... 405/12

FOREIGN PATENT DOCUMENTS

DE 24 61 143 * 7/1975
FR 2 338 842 A 8/1977
JP 62-261592 * 11/1987

* cited by examiner

*Primary Examiner*—Sherman Basinger
(74) *Attorney, Agent, or Firm*—Sughrue Mion, PLLC

(57) ABSTRACT

The invention applies to installing and/or removing a steerable propulsion pod for a ship having two of said steerable propulsion pods, each pod comprising a bulb suspended from the ship by a fin. The device comprises a cradle for receiving the pod to be moved, which cradle is situated between two arms of a buoyant beam, one end of each arm being rigidly secured to said cradle, the other end of a first arm being provided with a coupling hinged about a horizontal pin for coupling it to the fin of the other pod in place on the ship, the other end of the second arm being provided with a coupling hinged about a horizontal pin and about a vertical pin for coupling the second arm to an auxiliary vessel.

1 Claim, 7 Drawing Sheets

DEVICE FOR INSTALLING AND/OR REMOVING A STEERABLE PROPULSION POD FOR A SHIP

The present invention relates to a device for installing and/or removing a steerable propulsion pod for a ship having two of said steerable propulsion pods, each pod comprising a bulb suspended from the ship by a fin.

BACKGROUND OF THE INVENTION

For example, it is desirable, in the event of damage, to be able to replace such a propulsion pod rapidly without laying up the ship for a long time and without requiring a dry dock.

OBJECTS AND SUMMARY OF THE INVENTION

The invention thus provides such a device comprising a cradle for receiving the pod to be moved, which cradle is situated between two arms of a buoyant beam, one end of each arm being rigidly secured to said cradle, the other end of a first arm being provided with coupling means hinged about a horizontal pin for coupling it to the fin of the other pod in place on the ship, the other end of the second arm being provided with coupling means hinged about a horizontal pin and about a vertical pin for coupling the second arm to an auxiliary vessel.

BRIEF DESCRIPTION OF THE DRAWINGS

An embodiment of the invention is described below with reference to the accompanying drawings, in which.

MORE DETAILED DESCRIPTION

Figure 1:
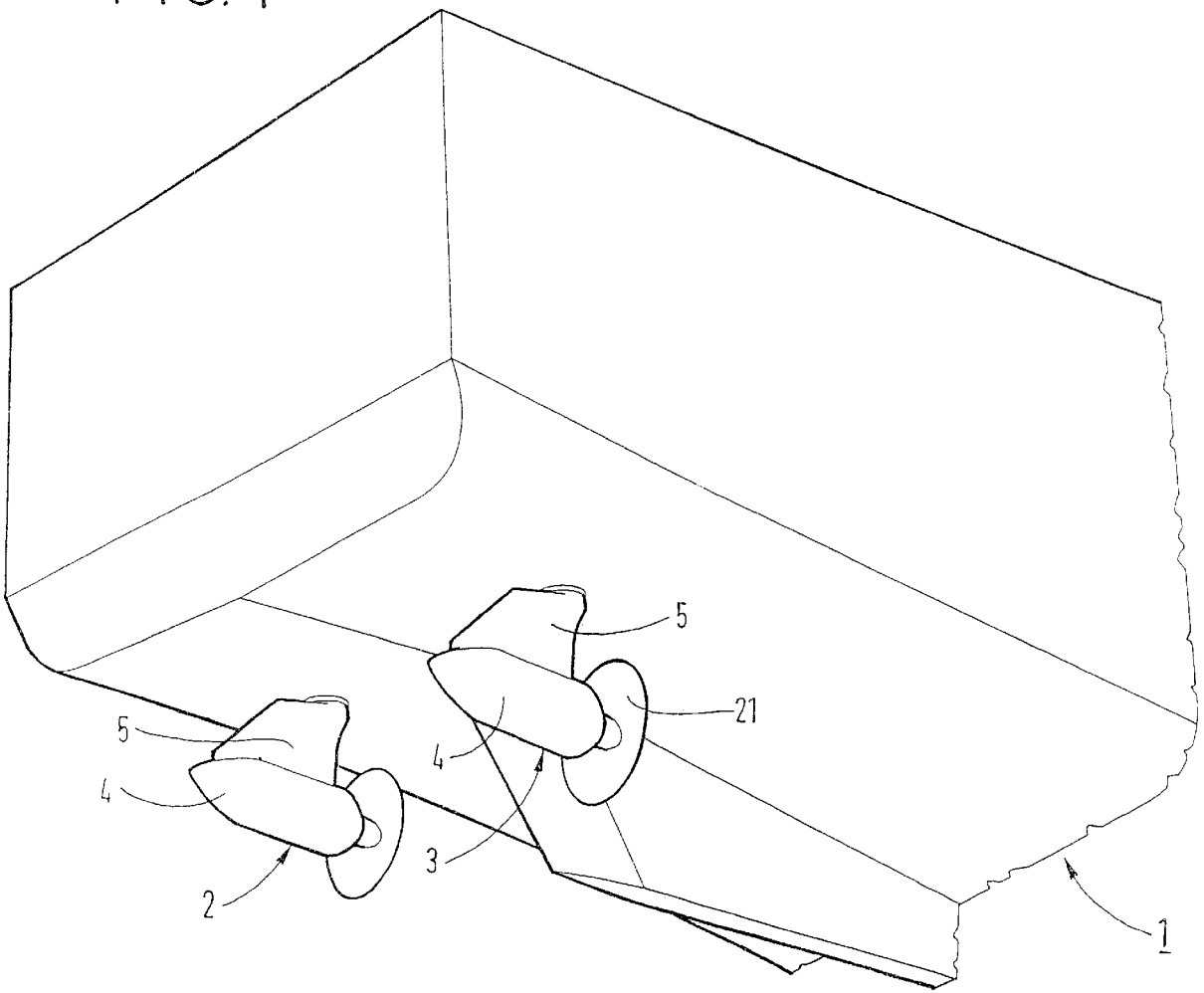
FIG. 1 is a diagrammatic view of the stern portion of a ship equipped with two steerable propulsion pods.

FIG. 1 thus shows the stern portion of a ship 1 equipped with two steerable propulsion pods 2 and 3, each pod comprising a bulb 4 suspended from the ship by a fin 5 serving as a rudder.

Figure 2:
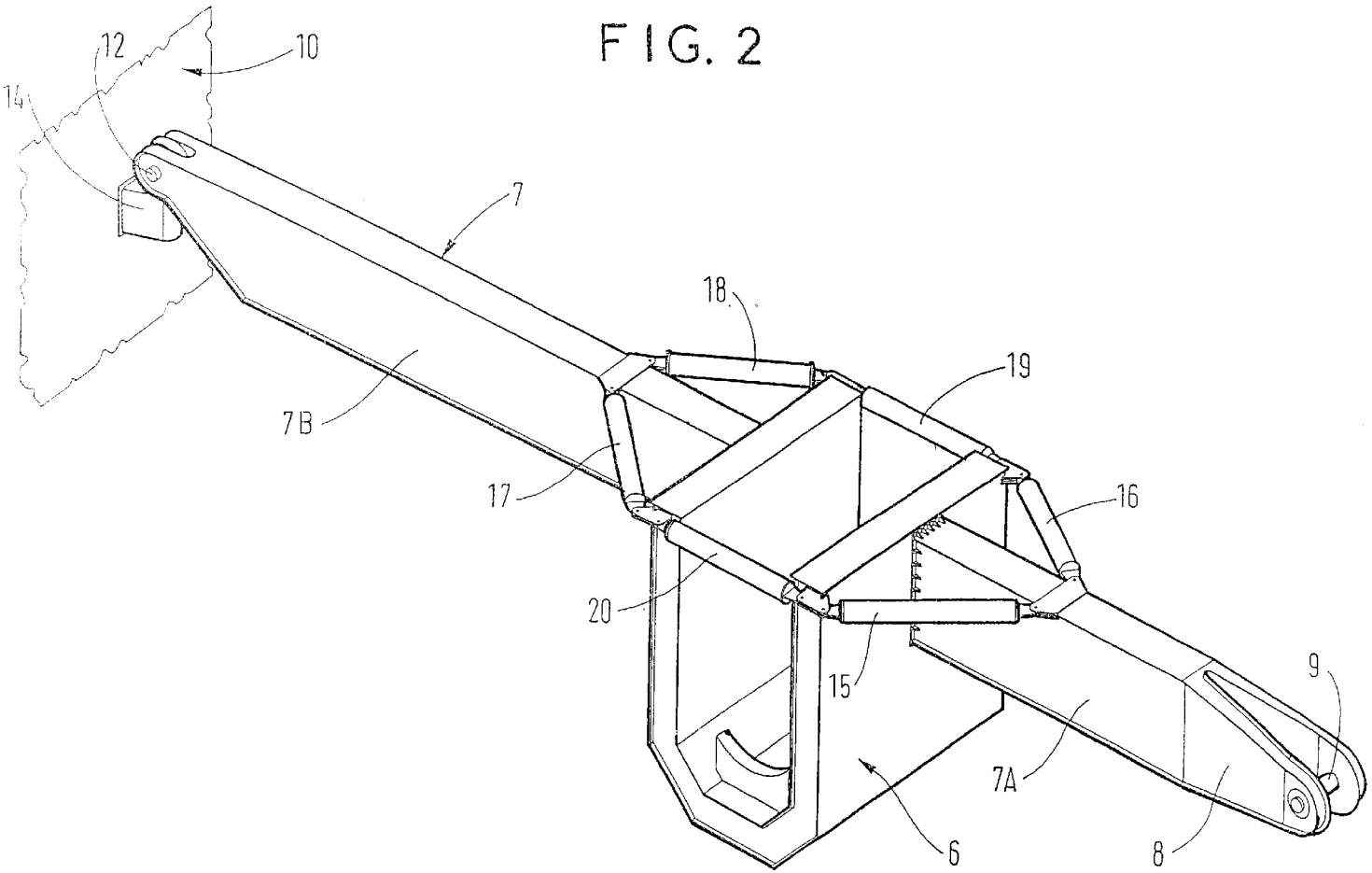
FIG. 2 is a perspective view of the device of the invention for installing and removing a propulsion pod for a ship equipped with two steerable propulsion pods.

FIG. 2 shows a device of the invention for installing a pod on a ship and/or removing a pod therefrom, the ship being equipped with a second pod that is in place.

The device comprises a cradle 6 for receiving the pod to be removed or to be installed, the cradle being fixed between two arms 7A and 7B of a buoyant beam 7. For example, the beam may be a hollow and compartmented metal beam.

The first arm 7A of the beam 7 is rigidly secured via one of its ends to the cradle 6, while its other end is provided with a fork 8 for hinging it about a horizontal pin 9 to the fin 5 of a pod in place on the ship 1. The pod in place on the ship serves as a first bearing point for the beam 7 (7A, 7B) while removing or installing the other pod. In the example described, the pod 2 is removed, and it is thus the pod 3 that is used as a first bearing point for the beam 7, as shown in FIGS. 4 to 7.

The second arm 7B of the beam 7 has a first end that is rigidly secured to the cradle 6, while its other end is provided with hinged coupling means that are hinged about two mutually perpendicular pins for coupling the second arm to an auxiliary vessel 10.

Figure 3:
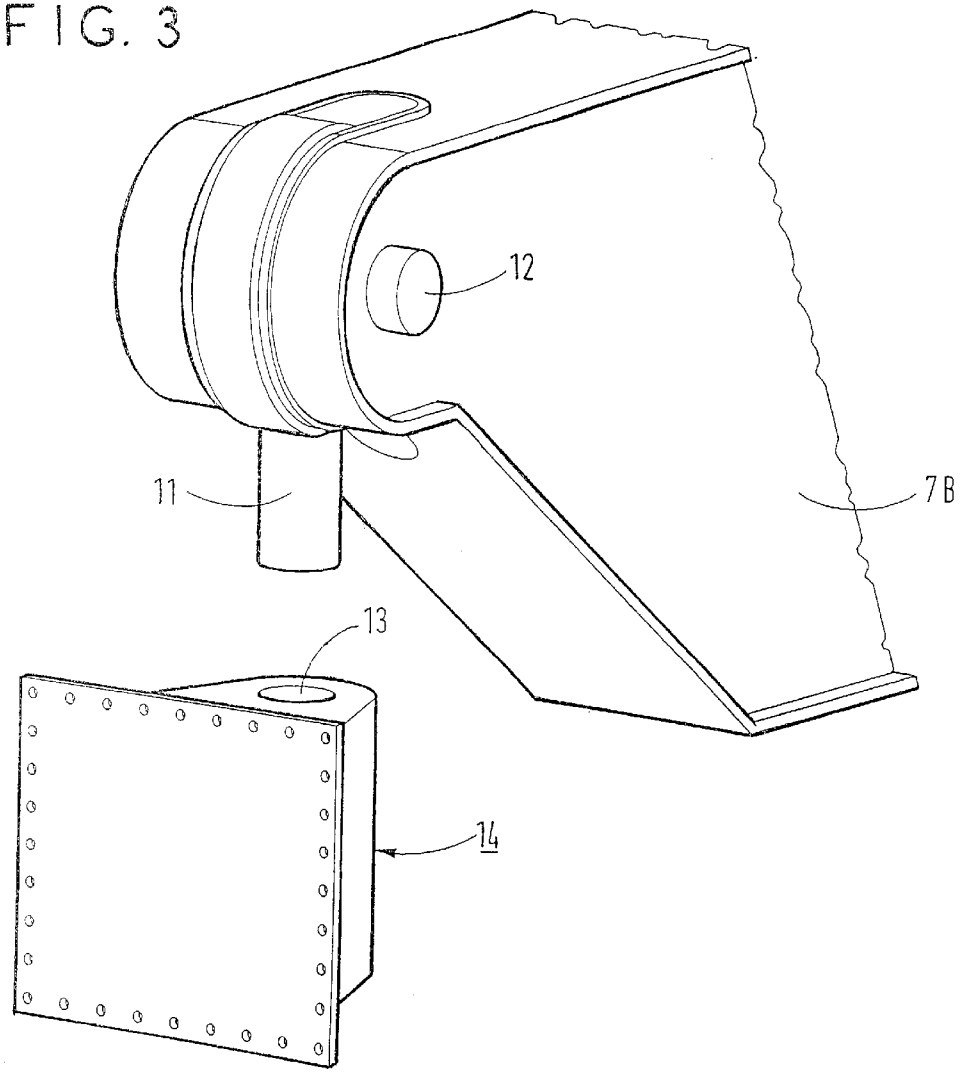
FIG. 3 is an enlarged view of hinged fixing means for fixing the end of one of the arms to an auxiliary vessel.

FIG. 3 more specially shows an example of this hinged coupling: it comprises a vertical pivot 11 coupled to a horizontal hinge pin 12 mounted to rotate at the free end of the arm 7B, while the pivot 11 serves to be inserted into a vertical circular orifice 13 of a pivot support 14 secured to the auxiliary vessel 10.

The auxiliary vessel 10 may be of any type of vessel: metal caisson, barge, support ship, floating crane, etc. The auxiliary vessel can be ballasted or else the pivot support 14 is fixed to the vessel with means for adjusting its vertical position.

Reinforcing arms 15 to 18 stiffen the assembly and connect the cradle 6 to the beam 7.

Figure 7:
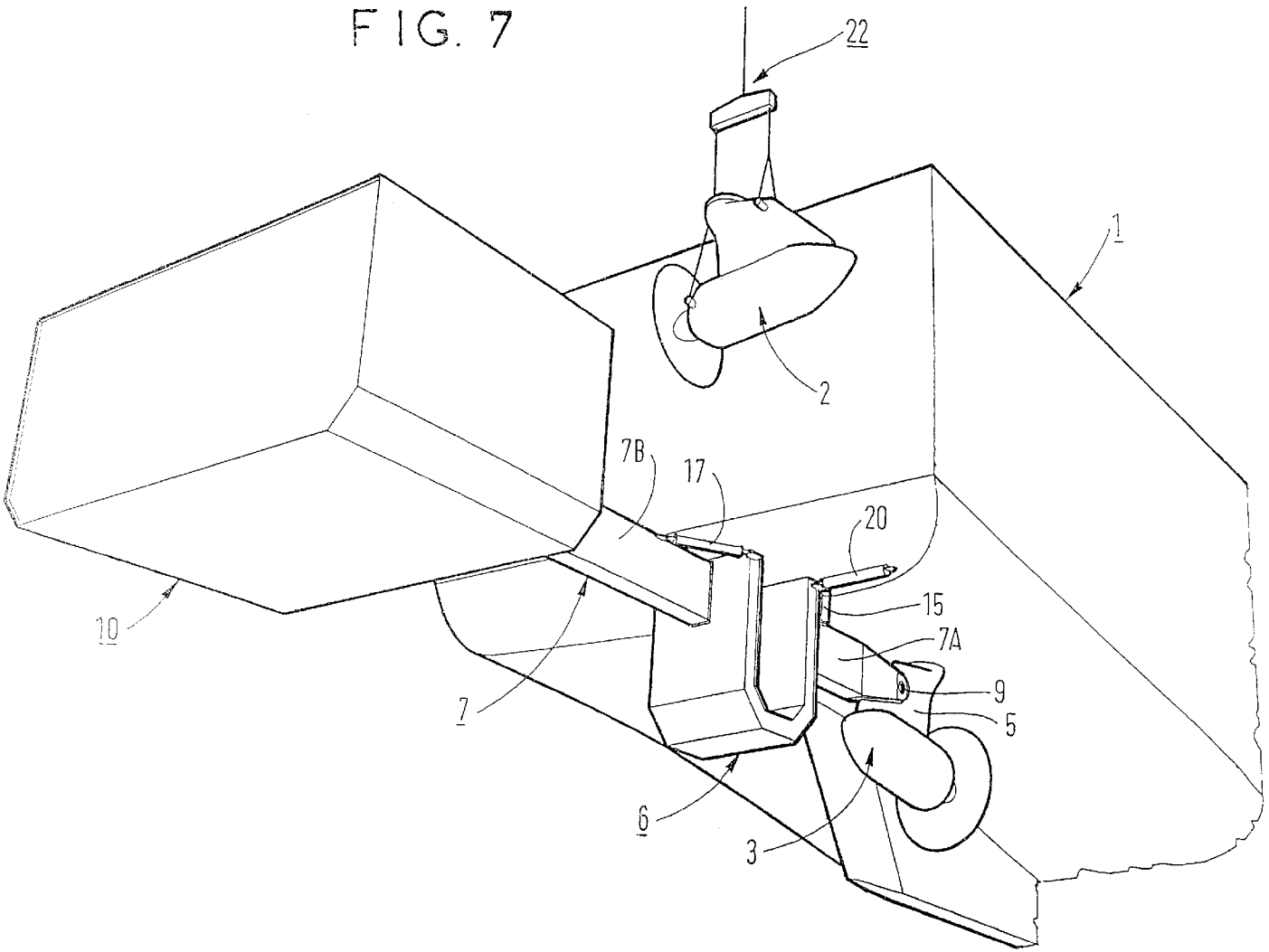

The spacing between the top ends of the U-shaped cradle 6 is maintained by arms 19 and 20 which are hinged to open so as to enable the pod to be extracted from its cradle by hoist means, or to be lowered into the cradle during a pod installation operation, as shown in FIG. 7. Retaining means (not shown) are provided for retaining the pod in the cradle.

FIGS. 4 to 7 show the various stages of removing the pod 2.

Figure 4:
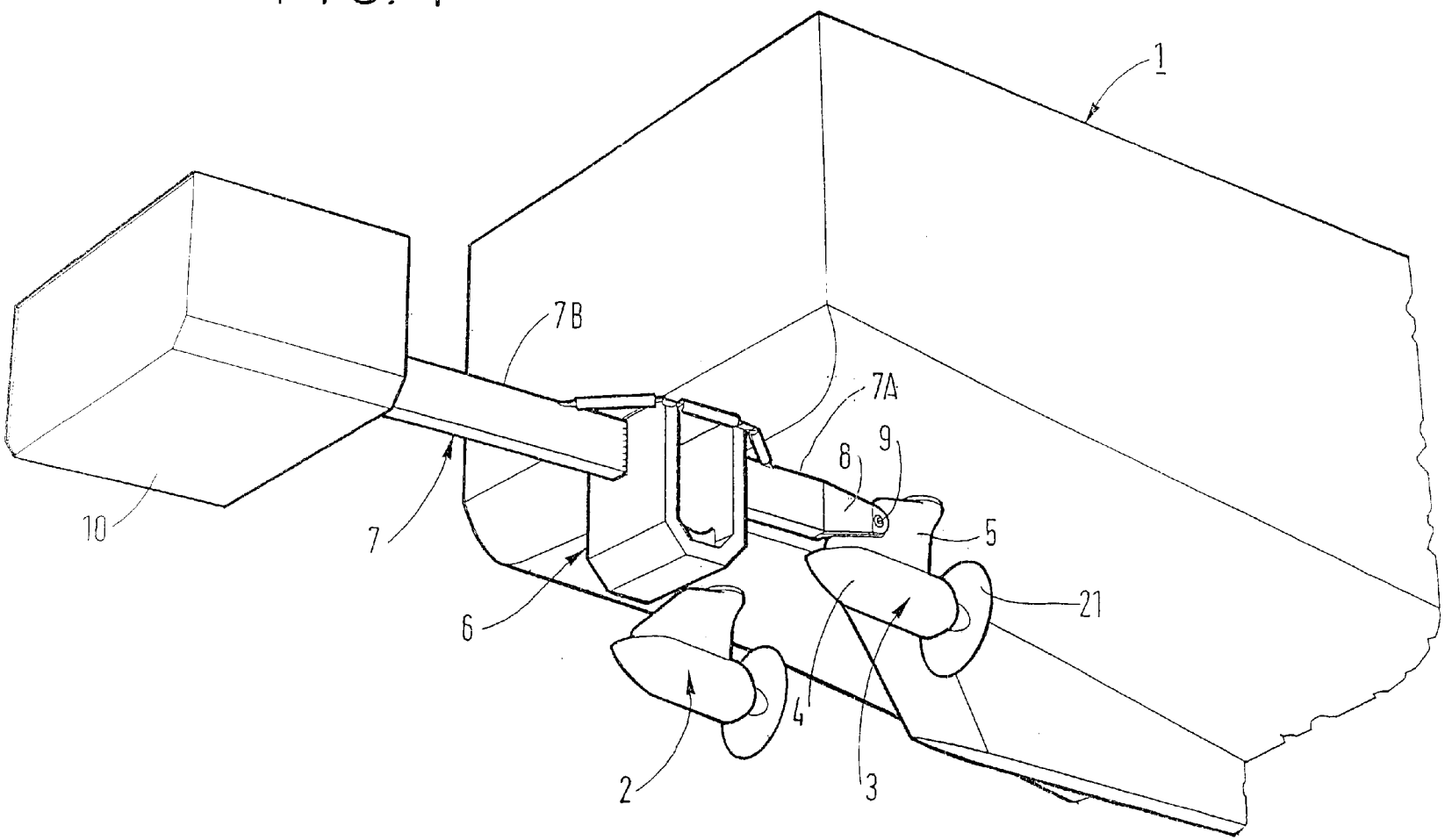
FIGS. 4 to 7 show the various stages of removal of a propulsion pod.
Figure 5:
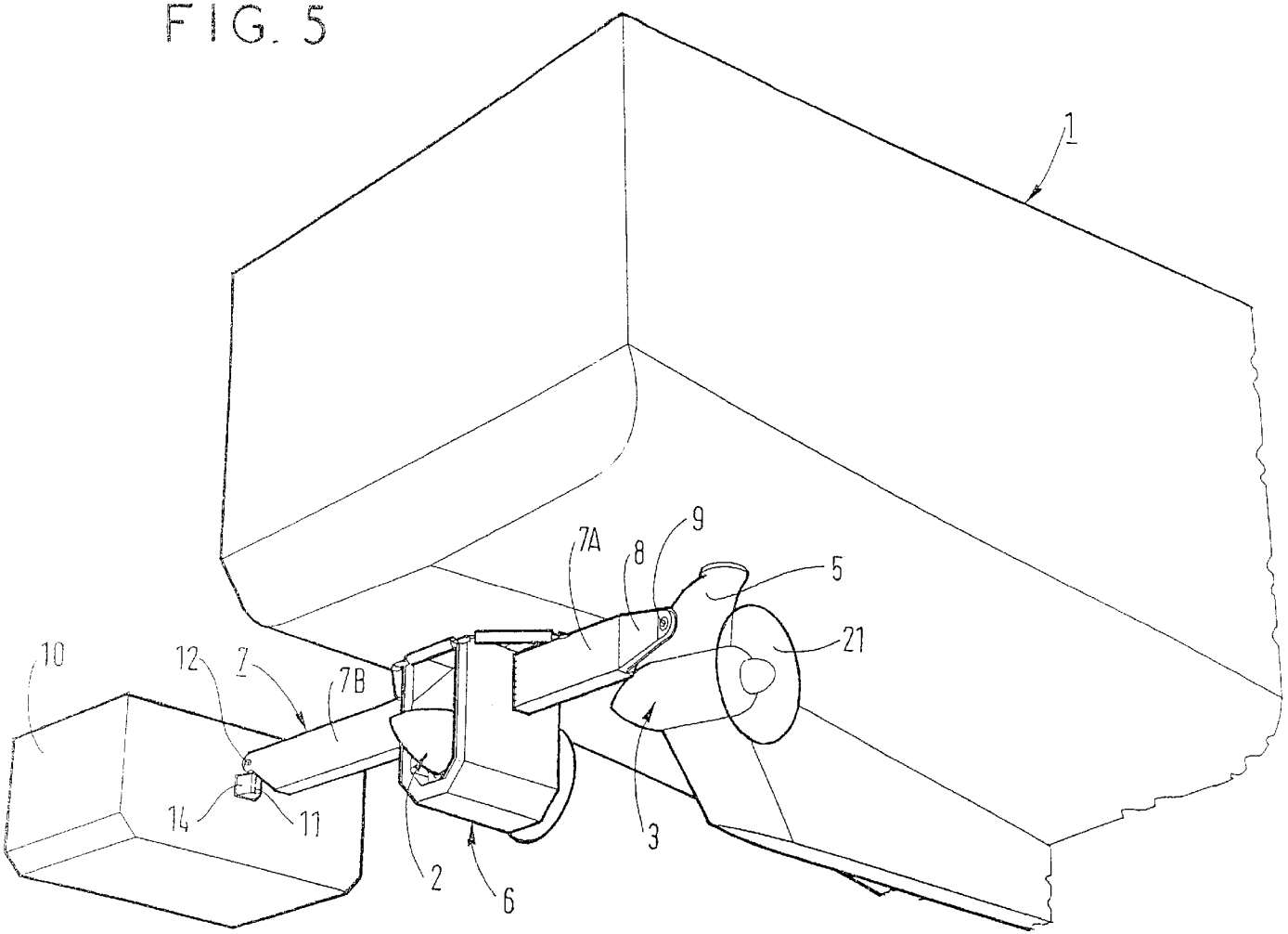

In FIG. 4, the pod 3 remaining in place is steered into its normal position, the propeller 21 being situated forward of the pod 4.

The beam 7, hinged to the auxiliary vessel 10, and whose other end floats, is brought towards the pod 3. The draft and the list of the ship 1 are adjusted by ballasting so as to enable the fork 8 on the arm 7A to engage the fin, and to be fixed thereto by the horizontal hinge pin 9.

The resulting assembly is then turned through 90° (FIG. 5) by using the motors for steering the pod 3, and optionally the motors associated with the auxiliary vessel 10.

The vessel 10 is ballasted sufficiently, or else the support 14 is lowered sufficiently for the pod 2 that is to be removed to be inserted into the cradle 6 without contact.

The vessel 10 is then deballasted, or the support 14 is raised, so that the cradle comes into contact with the pod 2 to be removed.

The pod 2 is retained in the cradle 6, and then the lifting force is increased so as to exert on the pod 2 an upward force that is slightly less than the weight of the pod.

It should be noted that the beam 7 constitutes a lever making it possible to share the weight to be borne between the pod 3 remaining in place and between the auxiliary vessel 10, in inverse ratio to the lengths of the arms 7A and 7B.

Figure 6:
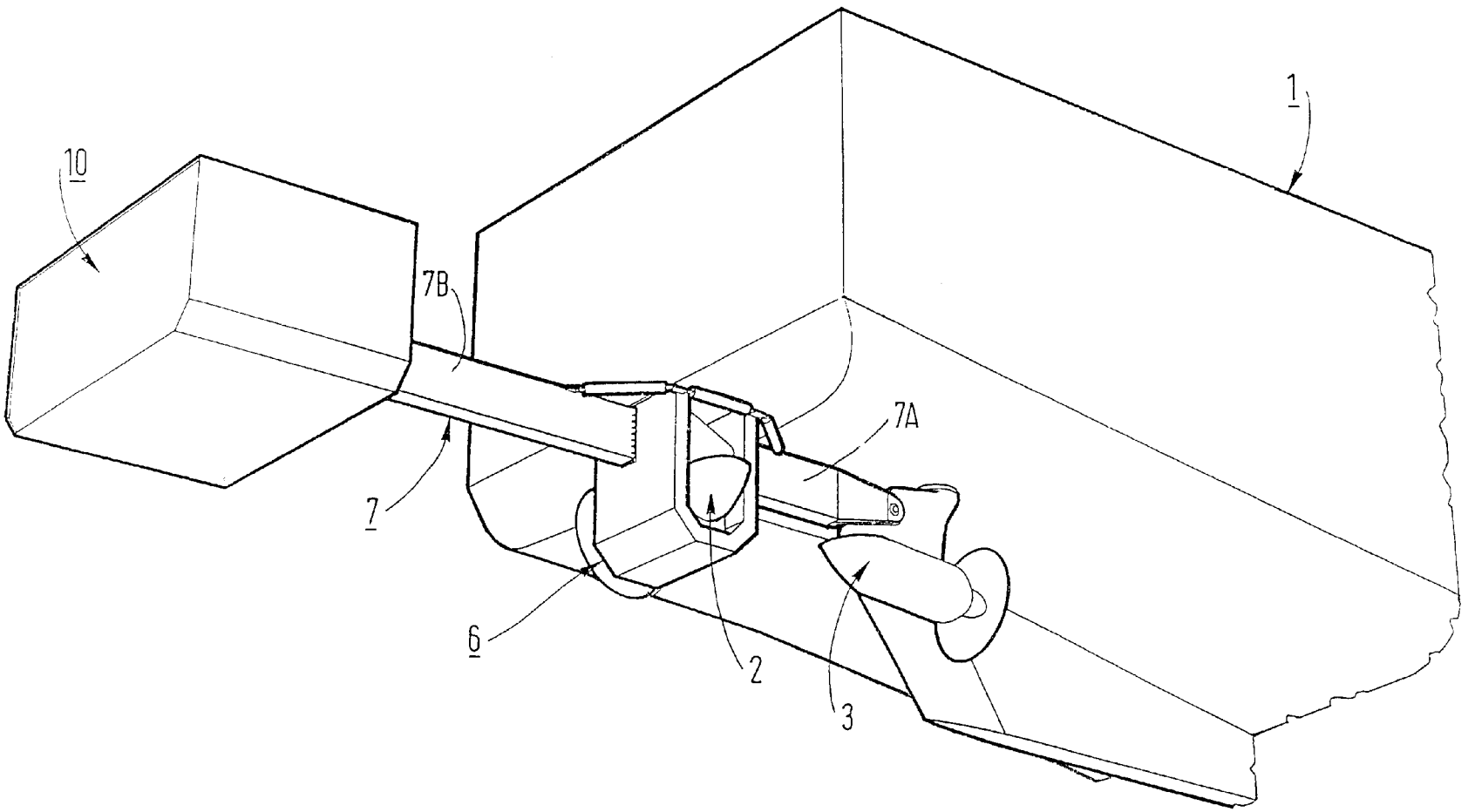

The pod 2 to be removed is then de-coupled from the ship via the means inside the ship for supporting the pod, then the support 14 is lowered, or else the auxiliary vessel 10 is ballasted, and the cradle 6, loaded with the pod 2, is moved clear of the bottom of the ship by turning the beam 7 through 90° in the opposite direction, using the means for steering the pod 3 and optionally drive means on the auxiliary vessel 10 (FIG. 6).

The arms 19, 20 (FIG. 2) are opened and, using hoist means 22 (FIG. 7), the pod 2 can be lifted clear.

For installing a pod, the reverse procedure is used.

The device of the invention is simple, as is the procedure for using it.

What is claimed is:

1. A device for installing and/or removing a steerable propulsion pod for a ship having two of said steerable propulsion pods, each pod comprising a bulb suspended from the ship by a fin, said device comprising a cradle for receiving the pod to be moved, which cradle is situated between two arms of a buoyant beam, one end of each arm being rigidly secured to said cradle, the other end of a first arm being provided with coupling means hinged about a horizontal pin for coupling it to the fin of the other pod in place on the ship, the other end of the second arm being provided with coupling means hinged about a horizontal pin and about a vertical pin for coupling the second arm to an auxiliary vessel.

* * * * *

UNITED STATES PATENT AND TRADEMARK OFFICE

CERTIFICATE OF CORRECTION

PATENT NO. : 6,564,736 B2
DATED : May 20, 2003
INVENTOR(S) : Roger Courtay

It is certified that error appears in the above-identified patent and that said Letters Patent is hereby corrected as shown below:

Title page,
Item [30], Foreign Application Priority Data, please delete "June 20, 2001" and insert -- June 27, 2001 --.

Signed and Sealed this

Thirtieth Day of August, 2005

JON W. DUDAS
*Director of the United States Patent and Trademark Office*